US011289867B2

(12) United States Patent
Particka et al.

(10) Patent No.: US 11,289,867 B2
(45) Date of Patent: Mar. 29, 2022

(54) WIRE GUIDE FOR ELECTRICAL TERMINAL APPLICATOR

(71) Applicant: Odyssey Tool, LLC, Clinton Township, MI (US)

(72) Inventors: Douglas A. Particka, Snover, MI (US); George J. Tilli, Clinton Township, MI (US)

(73) Assignee: Odyssey Tool, LLC, Clinton Township, MI (US)

( * ) Notice: Subject to any disclaimer, the term of this patent is extended or adjusted under 35 U.S.C. 154(b) by 118 days.

(21) Appl. No.: 16/655,813

(22) Filed: Oct. 17, 2019

(65) Prior Publication Data

US 2020/0083657 A1 Mar. 12, 2020

Related U.S. Application Data

(62) Division of application No. 15/345,861, filed on Nov. 8, 2016, now Pat. No. 10,454,234.

(51) Int. Cl.
*H01R 43/04* (2006.01)
*H01R 43/055* (2006.01)

(52) U.S. Cl.
CPC ..... *H01R 43/055* (2013.01)

(58) Field of Classification Search
CPC ..... H01R 43/055; H01R 43/052
See application file for complete search history.

(56) References Cited

U.S. PATENT DOCUMENTS 6,026,562 A * 2/2000 McMillin ..... H01R 43/055 29/33 M
6,327,775 B1 * 12/2001 Oishi ..... H01R 43/055 29/33 M
6,367,148 B1 * 4/2002 Caveney ..... H01R 43/055 29/33 M
7,117,713 B2 * 10/2006 Lu ..... H01R 43/055 72/409.14
7,565,735 B2 * 7/2009 Garner, Jr. ..... H01R 43/055 29/751
8,544,166 B2 * 10/2013 Particka ..... H01R 43/048 29/753
8,578,597 B2 * 11/2013 Dobson, Jr. ..... H01R 43/055 29/753
8,973,256 B2 * 3/2015 Particka ..... H01R 43/048 29/753

(Continued)

*Primary Examiner* — Paul D Kim
(74) *Attorney, Agent, or Firm* — Vivacqua Crane PLLC

(57) ABSTRACT

A wire guide system includes a wire guide tool assembly mounted to a die of a press automatically connecting an electrical terminal to a wire subassembly. An upper wire guide has a hemispherical shaped upper wire guide portion. A lower wire guide has a hemispherical shaped lower wire guide portion. The upper wire guide moves reciprocally to the lower wire guide. The hemispherical shaped upper and lower wire guide portions when the upper wire guide contacts the lower wire guide combine to temporarily define a conical wire guide aligned with a terminal barrel of the electrical terminal. A lifter is slidably received in the lower wire guide. The lifter displaces a terminal barrel of the electrical terminal away from contact with the lower wire guide after the electrical terminal is crimped to the wire subassembly, providing clearance to automatically remove the wire subassembly from the wire guide tool assembly.

6 Claims, 18 Drawing Sheets

(56) References Cited

U.S. PATENT DOCUMENTS

| | | | | |
|---|---|---|---|---|
| 9,484,701 | B2 * | 11/2016 | Particka | H01R 43/055 |
| 2009/0255112 | A1 * | 10/2009 | Garner, Jr. | H01R 43/055 29/861 |

* cited by examiner

WIRE GUIDE FOR ELECTRICAL TERMINAL APPLICATOR

CROSS REFERENCE TO RELATED APPLICATIONS

The present application is a divisional of U.S. application Ser. No. 15/345,861 filed on Nov. 8, 2016, now U.S. Pat. No. 10,454,234.

FIELD

The present disclosure relates to terminal feed and tool support components for electrical terminal applicators.

BACKGROUND

The statements in this section merely provide background information related to the present disclosure and may or may not constitute prior art.

Dies connected to and reciprocated by a press are commonly used to attach an electrical terminal to a wire by crimping the terminal to both the insulation and a stripped portion of the wire. Electrical terminals are commonly provided on a reel attached to a tape or carrier strip which positions successive terminals at a predefined, equal spacing. The die commonly includes a feed platen or plate which received the carrier strip and aligns each terminal with a tool portion. The tool portion commonly includes an insulation stripper, first and second crimp tools, and first and second anvils each vertically aligned under one of the first or second crimp tools. An incremental terminal feeding member such as a feed finger can also be used to incrementally feed a next-in-line terminal from the feed platen to the tool portion with each stroke of a ram provided with the press.

A first connection is commonly created by the first crimp tool and first anvil by crimping the terminal and a stripped wire portion. A second connection is created by the second crimp tool and second anvil by crimping tabs of the terminal about an insulated portion of the wire proximate to the stripped wire portion. Known installation tools can only be operated by manual insertion of the stripped wire portion followed by activation of the press. Known tools do not allow for automatic operation because there is no automatic release of the crimped terminal and wire, and no method to provide clearance to automatically release the terminal and wire after the crimping operation, therefore limiting the hourly production rate.

SUMMARY

The present invention provides a general summary of the disclosure and is not a comprehensive disclosure of its full scope or all of its features.

According to several aspects of the present disclosure, a wire guide system includes a wire guide tool assembly acting to automatically connect an electrical terminal to a wire subassembly. An upper wire guide of the wire guide tool assembly is movable reciprocally with respect to a lower wire guide such that the upper wire guide temporarily contacts the lower wire guide. A lifter is slidably disposed with respect to the lower wire guide. The lifter displaces a terminal barrel of the electrical terminal away from contact with the lower wire guide after the electrical terminal is crimped to the wire subassembly and the upper wire guide is moved away from the lower wire guide, thereby providing clearance to automatically remove the wire subassembly having the electrical terminal crimped thereto from the wire guide tool assembly.

According to further aspects, the upper wire guide includes a hemispherical shaped upper wire guide portion.

According to other aspects, the lower wire guide includes a hemispherical shaped lower wire guide portion.

According to other aspects, when the upper wire guide portion contacts the lower wire guide portion a conical wire guide is temporarily formed from a combination of the hemispherical shaped upper wire guide portion and the hemispherical shaped lower wire guide portion, the conical wire guide coaxially receiving a stripped wire directed into the terminal barrel of the electrical terminal.

According to further aspects, the hemispherical shaped face defining the lower wire guide portion is created in a cutter.

According to other aspects, a cutter spring biases the cutter; and a lifter spring biases the lifter, wherein the cutter spring is positioned oppositely about the cutter from the lifter spring and is oppositely directed with respect to the lifter spring.

According to other aspects, a compressor has legs extending from the compressor. The lifter is initially downwardly displaced against the biasing force of the lifter spring by the legs of the compressor prior to insertion of the wire assembly.

According to further aspects, a punch assembly has an insulation adjuster, a conductor punch, an insulation punch, and a compressor having multiple legs; and an anvil assembly has a conductor anvil and an insulation anvil.

According to other aspects, after a first stage of operation, a ram together with the punch assembly defining a ram assembly are moved until legs of the compressor depress against the lifter and the insulation punch secures the terminal barrel of the electrical terminal.

According to other aspects, after a second stage of operation, the ram assembly is displaced until the cutter separates the terminal barrel of the electrical terminal from a carrier having multiple ones of the electrical terminals, and the upper wire guide contacts the lower wire guide forming a conical wire guide.

According to further aspects, after a third stage of operation, a stripped wire is received through the conical wire guide and is positioned in the terminal barrel of the electrical terminal.

According to other aspects, after a fourth stage of operation, a crimping tool punch and the insulation punch engage the conductor anvil and the insulation anvil compressing the terminal barrel positioned in the conical wire guide thereby forming a crimped terminal.

According to other aspects, a tubular shaped activator slidably received in a through aperture created in a flange of the upper wire guide when the upper wire guide contacts the lower wire guide.

According to further aspects, the lifter includes a guide pin slidably received in a slot created in the lower wire guide.

According to other aspects, a method is provided for automatically crimping and removing a wire subassembly from a wire guide tool assembly, the wire guide tool assembly releasably mounted to a die acting during operation of a press. The method comprises: feeding a carrier containing multiple electrical terminals into the die; displacing an upper wire guide of the wire guide tool assembly having a hemispherical shaped upper wire guide portion into contact with a lower wire guide having a hemispherical shaped lower wire guide portion, such that the hemispherical shaped upper wire guide portion and the hemispherical shaped lower wire guide portion temporarily define a conical wire guide aligned with a terminal barrel of a next one of the electrical terminals; inserting a stripped wire through the conical wire guide into the terminal barrel of the next one of the electrical terminals; crimping the terminal barrel to the stripped wire to create a wire subassembly; and biasing a lifter to displace the wire subassembly away from contact with the lower wire guide, thereby providing clearance to automatically remove the wire subassembly from the wire guide tool assembly.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
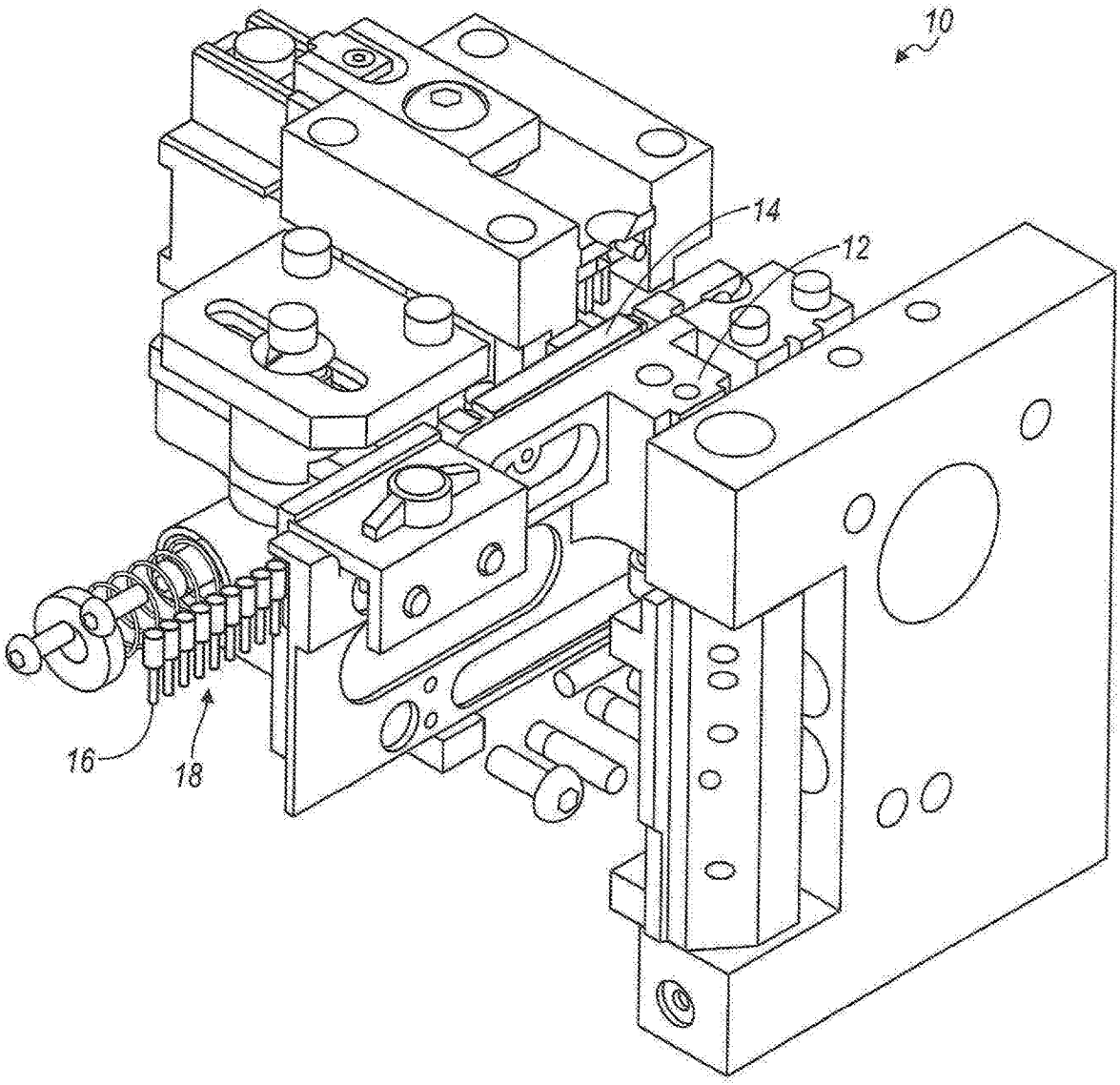
FIG. 1 is a top left perspective partial assembly vie of a feed guide and tool guide assembly of the present disclosure.

Referring to FIG. 1, an electrical terminal applicator system or wire guide system 10 includes a die 12 releasably retained on a press (not shown). A wire guide tool assembly 14 is releasably mounted to the die 12 and acts with operation of the press to automatically connect an electrical terminal 16 to a wire assembly 83 shown and described in greater detail in reference to FIG. 4, and to release the wire assembly and the electrical terminal 16 after a fixed connection is made. The electrical terminal 16 is separated during the installation sequence from a terminal strip 18 having multiple electrical terminals 16 each positioned in a fixed configuration.

Referring to FIG. 2 and again to FIG. 1, the wire guide tool assembly 14 includes an upper wire guide 20 movable reciprocally with respect to a lower wire guide 22. The upper wire guide 20 is slidably connected to a blade supporter 24, and the upper wire guide 20 also receives a biasing member 26 to provide a biasing force against the upper wire guide 20. A slitting blade 28 having a sharpened slitting end 30 at a free end is slidably disposed between the upper wire guide 20 and the blade supporter 24. The slitting blade 28 includes an elongated aperture 32 allowing a blade pin 34 to restrict sliding motion of the slitting blade 28 while also connecting the slitting blade 28 to the blade supporter 24.

The upper wire guide 20 also includes a semi-spherical shaped first guide surface 36 extending away from an end wall 38 of the upper wire guide 20. A semi-circular aperture portion 40 is provided at a small diameter end of the first guide surface 36. A flange 42 faces oppositely with respect to the first guide surface 36 and has a through aperture 44 extending through the flange 42. The through aperture 44 is sized to slidably receive a tubular shaped activator 46. The flange 42 also has a flange face 48 oriented parallel to, but stepped upwardly away from the end wall 38.

The lower wire guide 22 includes a semi-circular shaped second guide surface 40 which is a counterpart to the first guide surface 36 of the upper wire guide 20. When the end wall 38 of the upper wire guide 20 contacts a planar face 52 of the lower wire guide 22, the first and second semi-spherical shaped guided surfaces 36, 50 combine to define a spherical-shaped alignment surface for slidably receiving the wire assembly 83, shown and described in greater detail in reference to FIG. 4. At this time, a semi-circular aperture portion 54 provided at a small diameter end of the second guide surface 50 adjoins the semi-circular aperture portion 40 of the first guide surface 36 to create a wire receiving aperture. A shelf face 56 provided with the lower wire guide 22 is oriented parallel to the flange face 48 of the upper wire guide 20. The tubular shaped activator 46 is slidably received in the through aperture 44 created in the flange 42 when the upper wire guide 20 contacts the lower wire guide 22.

A rectangular shaped lifter 58 is slidably received in a similarly rectangular shaped slot created in the lower wire guide 22, and biased for sliding motion using a lifter biasing member 60 such as a compression spring. An end face 62 of the lifter 58 is normally positioned above an upper face 52 of the lower wire guide 22 when no terminal 16 is present. A recessed surface 49 is positioned below the position of the planar face 52 of the lower wire guide 22. The lifter 58 is also slidably received in a slot 64 created in a terminal ramp 66 which is oppositely positioned with respect to the lower wire guide 22. A canted lifter member 68 is integrally connected to the terminal ramp 66 and extends upwardly from an upper ramp face 70 of the terminal ramp 66.

Apertures provided through each of the lower wire guide 22, the terminal ramp 66, and an anvil 72 provide for fasteners (not shown) to releasably connect the lower wire guide 22, the terminal ramp 66, and the anvil 72, with the lifter 58 slidably received in the slot 64. The anvil 72 includes an anvil tongue 74 which is received in a punch portion 76 of a conductor punch 78. The conductor punch 78 is releasably fixed to the blade support 24 such that the conductor punch 78 is movable toward and away from the anvil 72 during operation of the press.

Each of the electrical terminals 16 includes a pre-molded tube 80. The shelf face 56 of the lower wire guide 22 and the flange face 48 of the upper wire guide 20 are separated by the approximate diameter of the tube 80, such that an inner bore 82 of the tube 80 coaxially aligns with the wire receiving aperture defined by the combination of the semi-circular aperture portion 54 provided at the small diameter end of the second guide surface 50 adjoining the semi-circular aperture portion 40 of the first guide surface 36 when the end wall 38 contacts the planar face 52. Each of the electrical terminals 16 also includes a hollow crimped portion 84 integrally connected to and coaxially aligned with the inner bore 82 of the tube 80.

Figure 2:
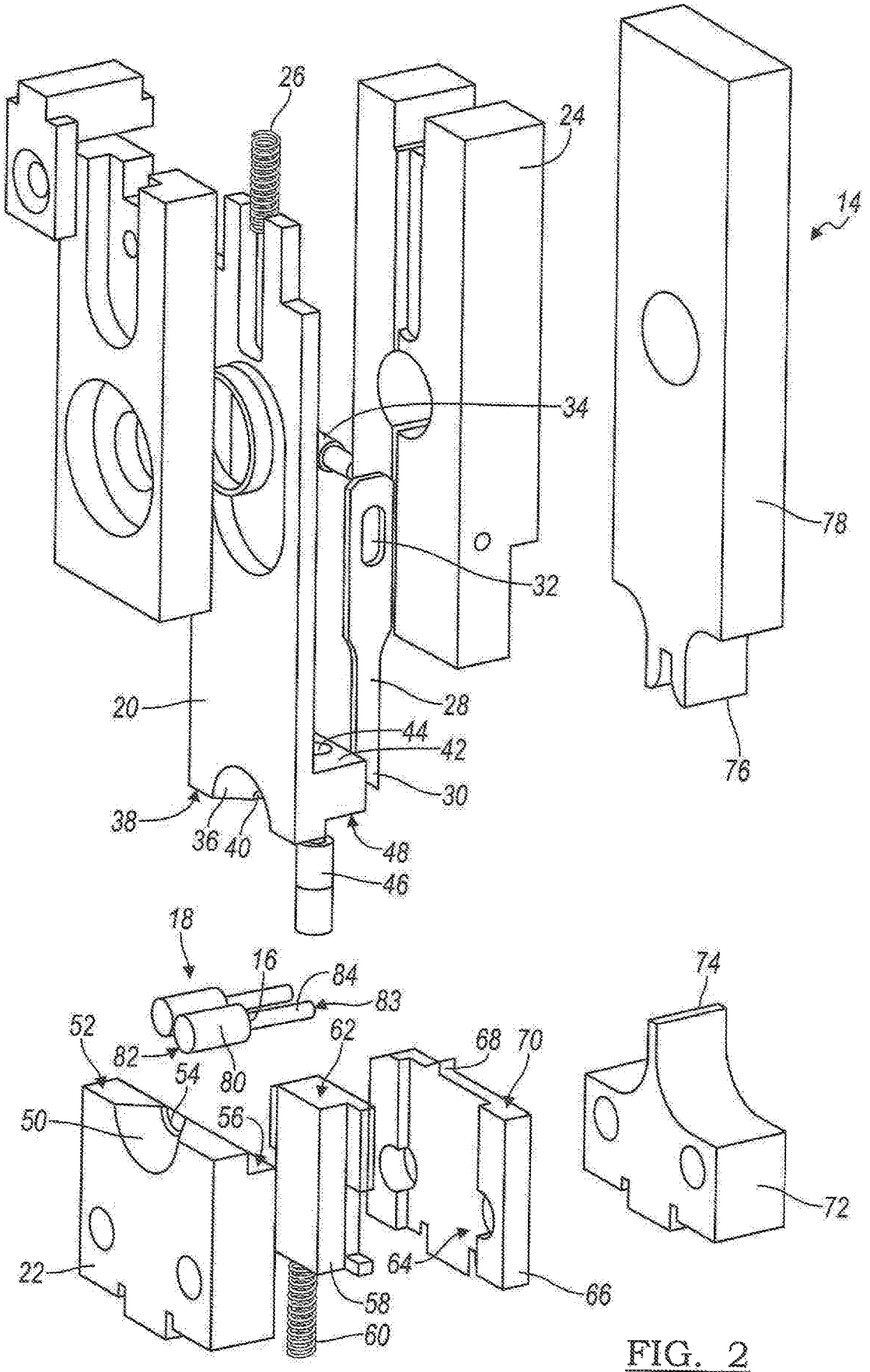
FIG. 2 is a front perspective assembly view of a wire guide tool assembly of FIG. 1.

Referring to FIG. 3 and again to FIG. 2, the wire guide tool assembly 14 is shown in an assembled condition in an open position to receive a next one of the electrical terminals 16 on the terminal strip 18. The tube 80 of the electrical terminal 16 directly contacts the end face 62 of the lifter 58 compressing the lifter biasing member 60, and also directly contacts the shelf face 56 of the lower wire guide 22. At this time, the crimped portion 84 of the electrical terminal 16 is aligned with the punch portion 76 of the conductor punch 78, and the slitting end 30 of the slitting blade 28 is spatially separated from the tube 80 of the electrical terminal 16 to allow entry of the electrical terminal 16.

Figure 3:
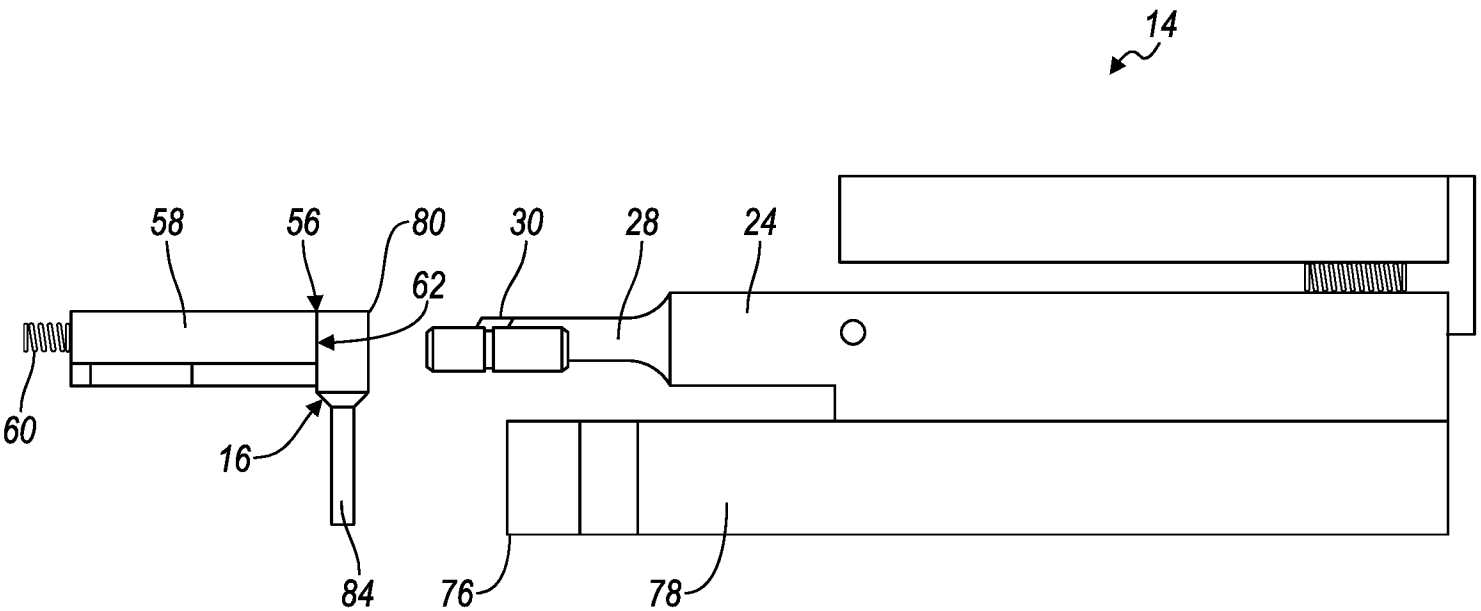
FIG. 3 is an end elevational view of the assembled wire guide tool assembly of FIG. 2 in a tool open position.

Referring to FIG. 4 and again to FIGS. 2-3, with the electrical terminal 16 in position against the lifter 58 and the lower wire guide 22, a wire subassembly 86 is positioned proximate to the wire guide tool assembly 14. The wire subassembly 86 includes a length of insulation 88 and a length of bare wire 90 stripped of the insulation 88. The blade supporter 24 and the punch portion 76, together with the slitting blade 28 are together moved in a press direction "A" toward the lower wire guide 22, which also displaces the activator 46 into contact with the lifter 58.

Figure 4:
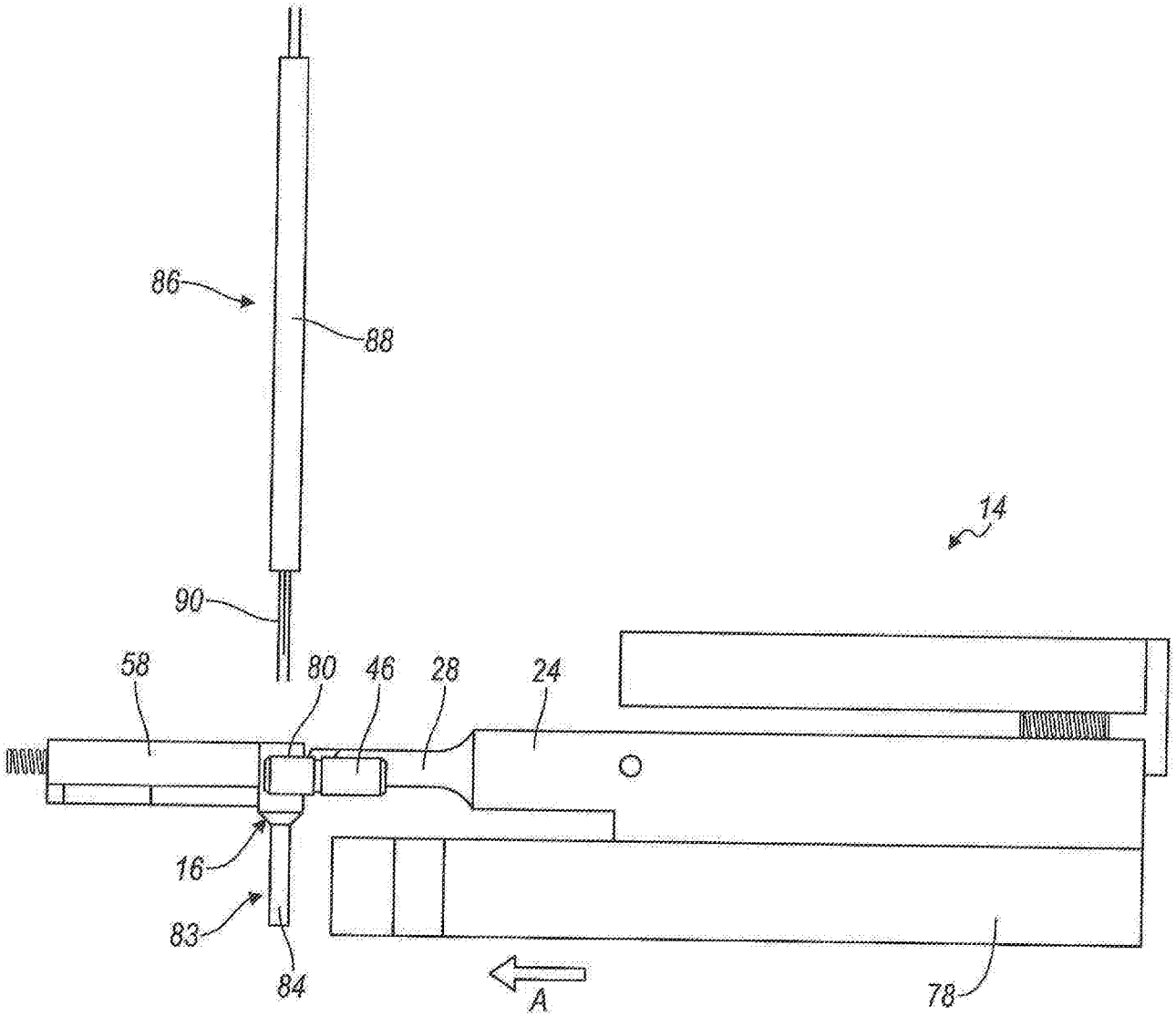
FIG. 4 is an end elevational view of the assembled wire guide tool assembly of FIG. 3 further showing a wire assembly.

Referring to FIG. 5 and again to FIGS. 2-4, the wire subassembly 86 is displaced in an installation direction "B" with the bare wire 90 moved into the wire receiving aperture defined by the combination of the semi-circular aperture portion 54 provided at the small diameter end of the second guide surface 50 and the semi-circular aperture portion 40 of the first guide surface 36. The bare wire 90 is thereby aligned with the inner bore 82 of the tube 80 such that the bare wire 90 coaxially aligns with the wire receiving aperture and the crimped portion 84 of the electrical terminal 16 when the end wall 38 contacts the planar face 52.

Figure 5:
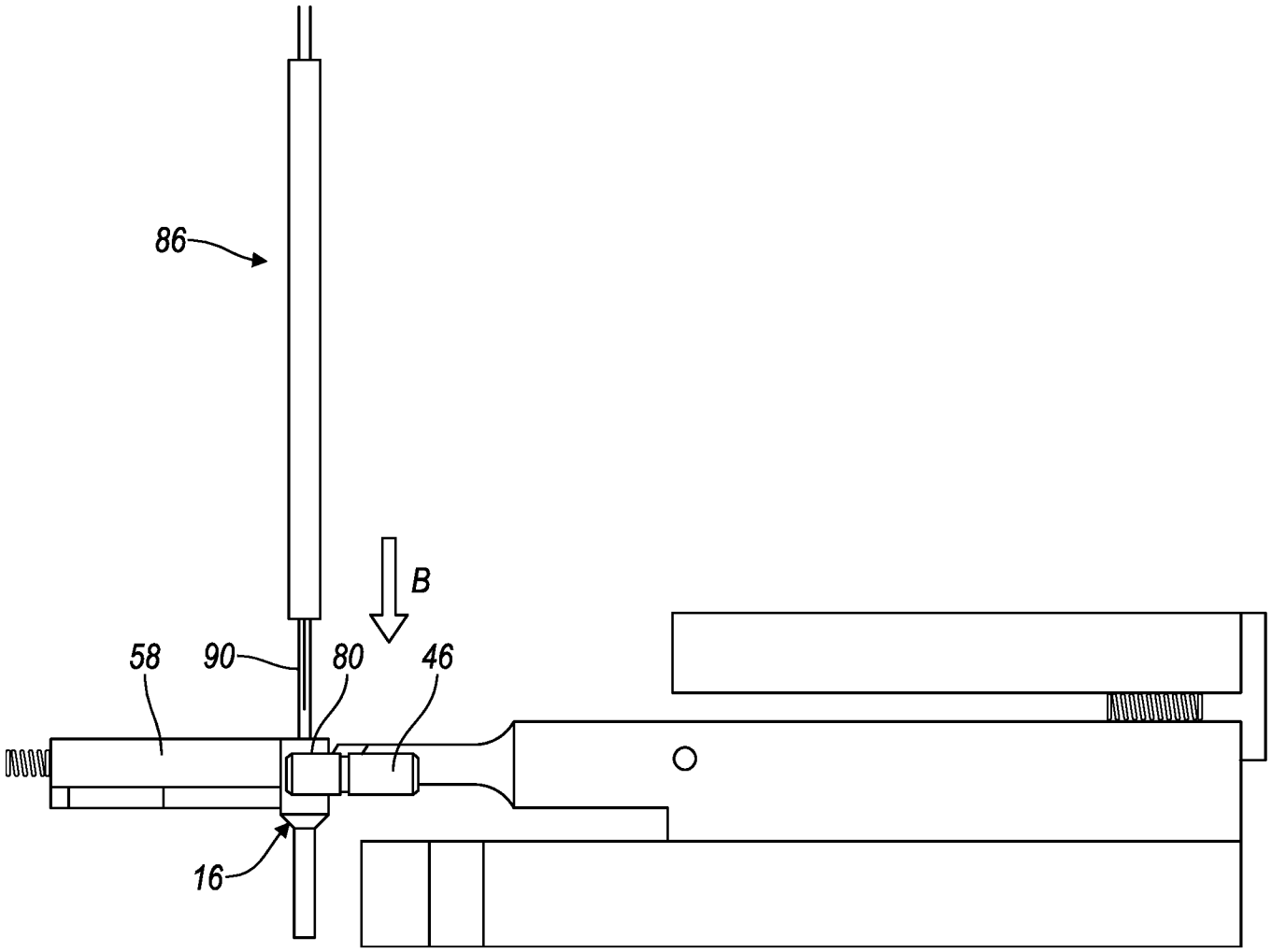
FIG. 5 is an end elevational view of the assembled wire guide tool assembly of FIG. 4 during insertion of the wire assembly.
Figure 6:
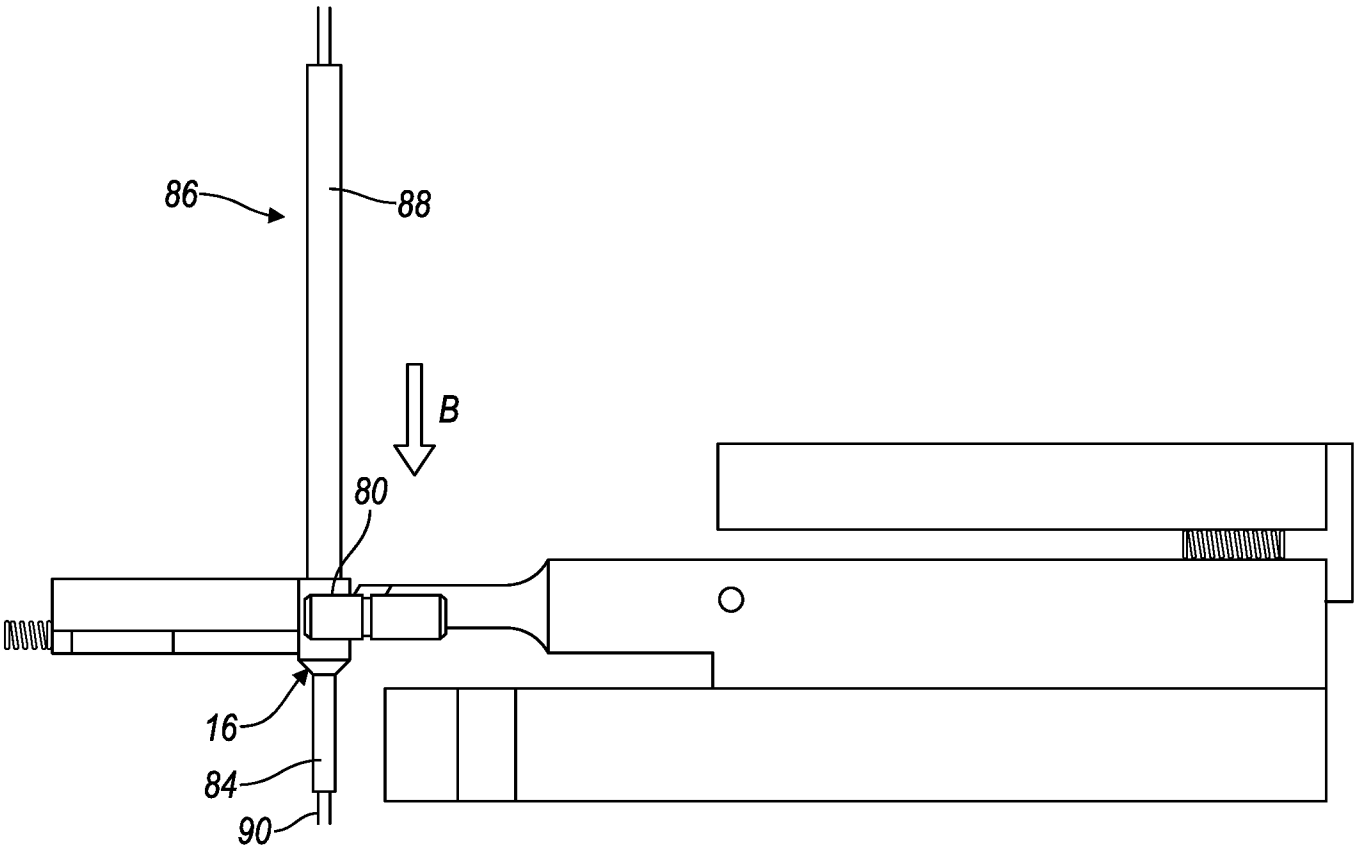
FIG. 6 is an end elevational view of the assembled wire guide tool assembly of FIG. 5 after wire assembly insertion but prior to crimping.

Referring to FIG. 6 and again to FIG. 5, the wire subassembly 86 is further displaced in the installation direction "B" until an end portion of the insulation 88 is slidingly received in the inner bore 82 of the tube 80 of the electrical terminal 16. At this time, the bare wire 90 enters the crimped portion 84 of the electrical terminal 16.

Figure 7:
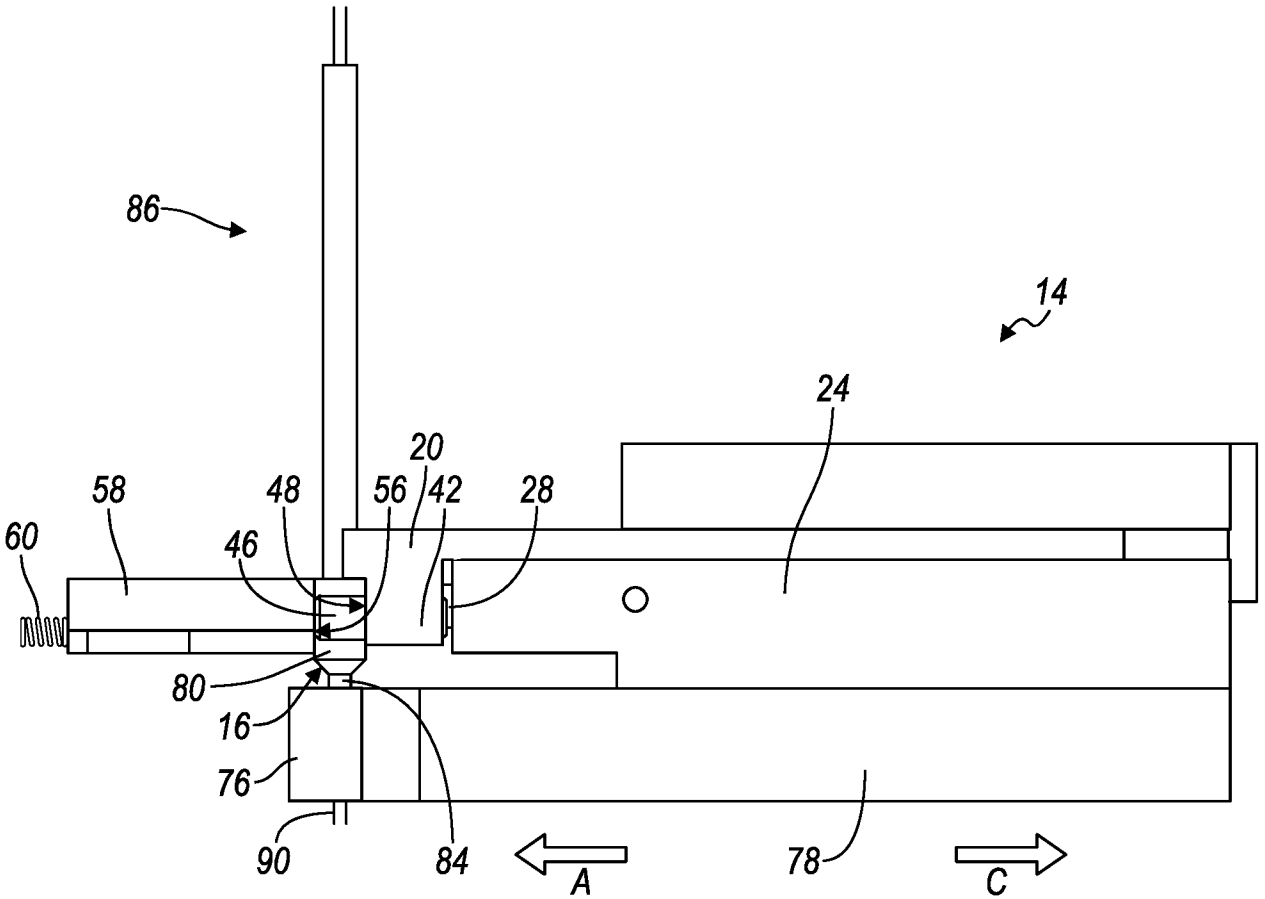
FIG. 7 is an end elevational view of the assembled wire guide tool assembly of FIG. 6 during the crimping operation.

Referring to FIG. 7 and again to FIGS. 2-6, after the bare wire 90 is received in the crimped portion 84 of the electrical terminal 16, the press is further operated to displace the upper wire guide 20 in the press direction "A" to provide a contact holding force between the flange face 48 of the upper wire guide 20 and the shelf face 56 of the lower wire guide 22 with the tube 80 of the electrical terminal 16. At this time the slitting blade 28 is also displaced in the press direction "A" to disconnect the electrical terminal 16 from the terminal strip 18. Also at this time, the conductor punch 78 is displaced in the press direction "A" until the crimped portion 84 of the electrical terminal 16, now containing the bare wire 90, is received in the punch portion 76. The crimped portion 84 of the electrical terminal 16 is crimped against the anvil tongue 74 of the anvil 72 (not visible in this view).

After the crimping operation is complete, the conductor punch 78, the blade supporter 24, the upper wire guide 20, and the slitting blade 28 are together withdrawn in a second press direction "C", opposite to the press direction "A", until the open positon of the wire guide tool assembly 14 shown in FIG. 3 is reached. During this displacement, the biasing force of the lifter biasing member 60 forces the lifter 58 to displace the tube 80 of the electrical terminal 16 away from contact with the lower wire guide 22, thereby providing clearance to automatically remove the wire subassembly 86 which how has the electrical terminal 16 crimped thereto.

Referring to FIG. 8 and again to FIGS. 2-3, the terminal strip 18 is fed into the wire guide tool assembly 14 in a feed direction "D", and can be indexed using the lifter member 68. A next-in-line one of the electrical terminals 16 moves until the tube 80 is positioned even with the aperture portion 54 provided at the small diameter end of the second guide surface 50 of the lower wire guide 22. The semi-circular aperture portion 40 is clear of the tube 80 in the open position.

Figure 8:
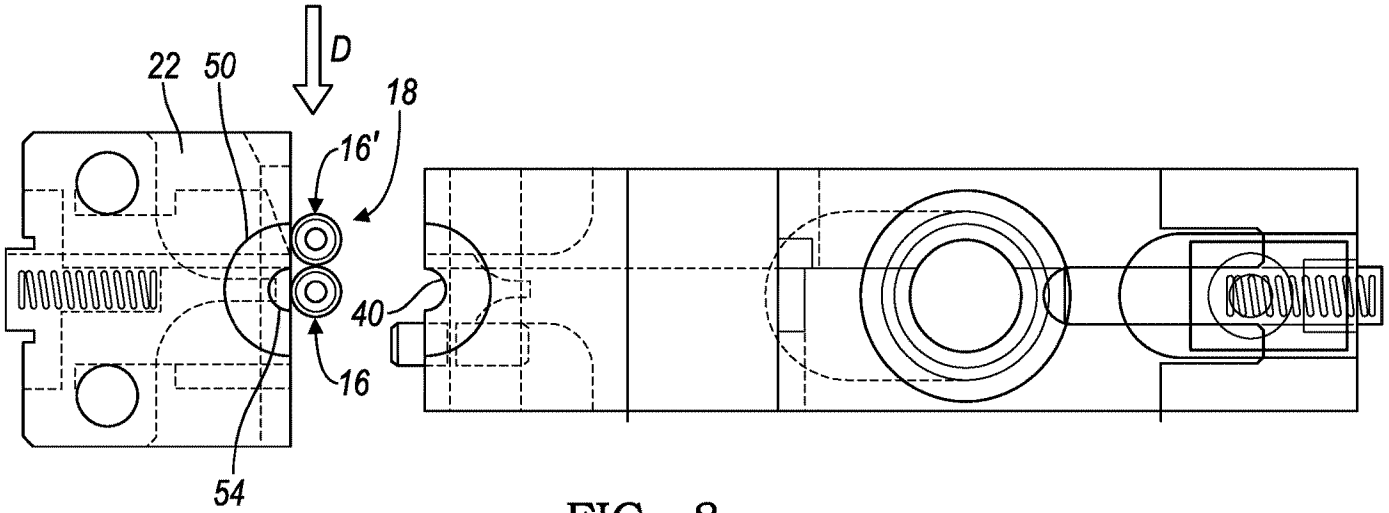
FIG. 8 is a front elevational view of the assembled wire guide tool assembly of FIG. 2 in the tool open position.

Referring to FIG. 9 and again to FIG. 8, when the tube 80 reaches the installation position shown, the lifter 58, biased away from the planar face 52 of the lower wire guide 22 directly contacts the tube 80. The activator 46 is positioned opposite to the tube 80, providing clearance for sliding motion of the terminal strip 18.

Figure 9:
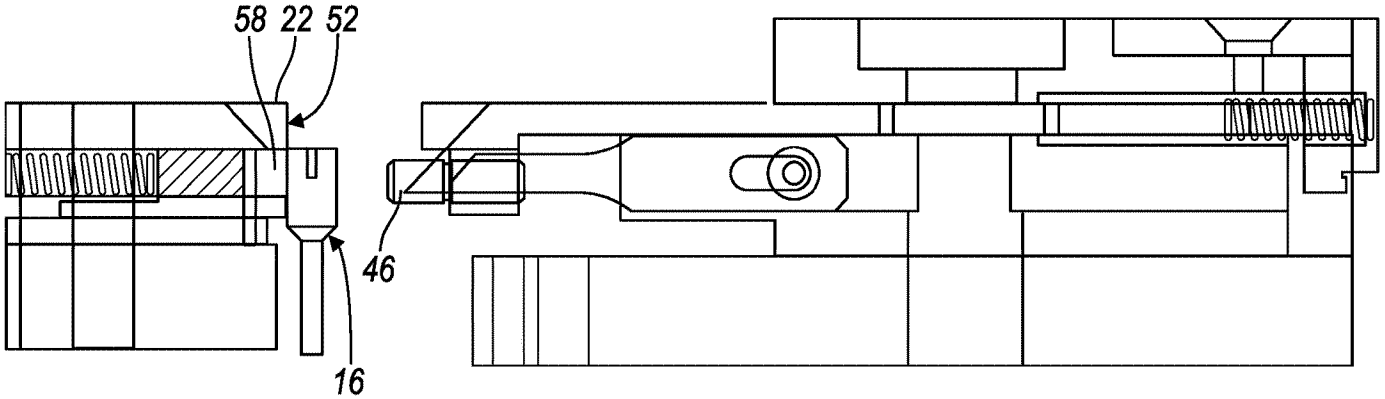
FIG. 9 is an end elevational view of the assembled wire guide tool assembly of FIG. 8.
Figure 10:
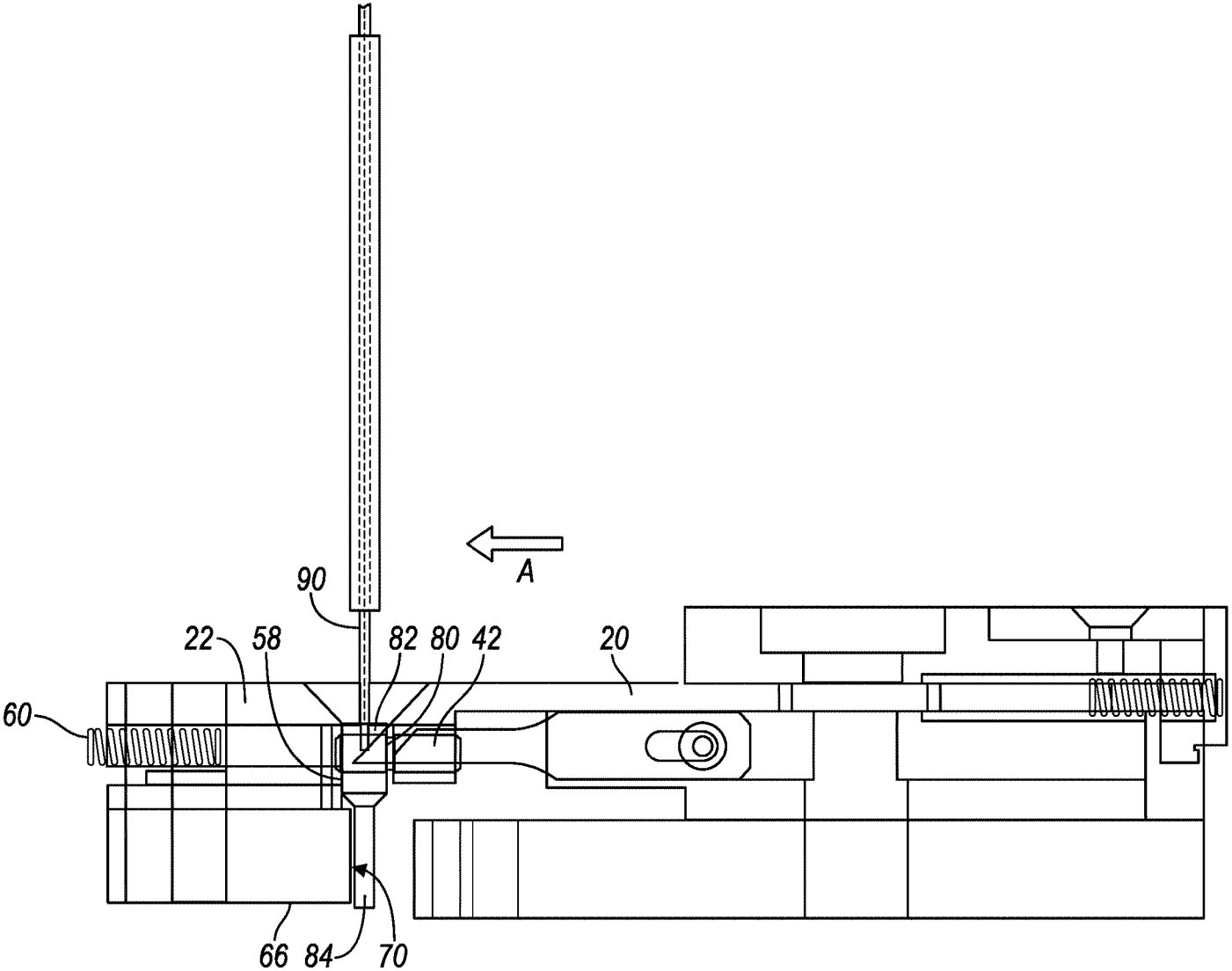
FIG. 10 is an end elevational view of the assembled wire guide tool assembly of FIG. 9 in a partially closed position.

Referring to FIG. 10 and again to FIGS. 4 and 8-9, the upper wire guide 20 is displaced in the installation direction "A" until the flange face 48 of the flange 42 contacts the tube 80, which also compresses the lifter biasing member 60. The upper ramp face 70 of the terminal ramp 66 also directly contacts the crimped portion 84 at this time.

Figure 11:
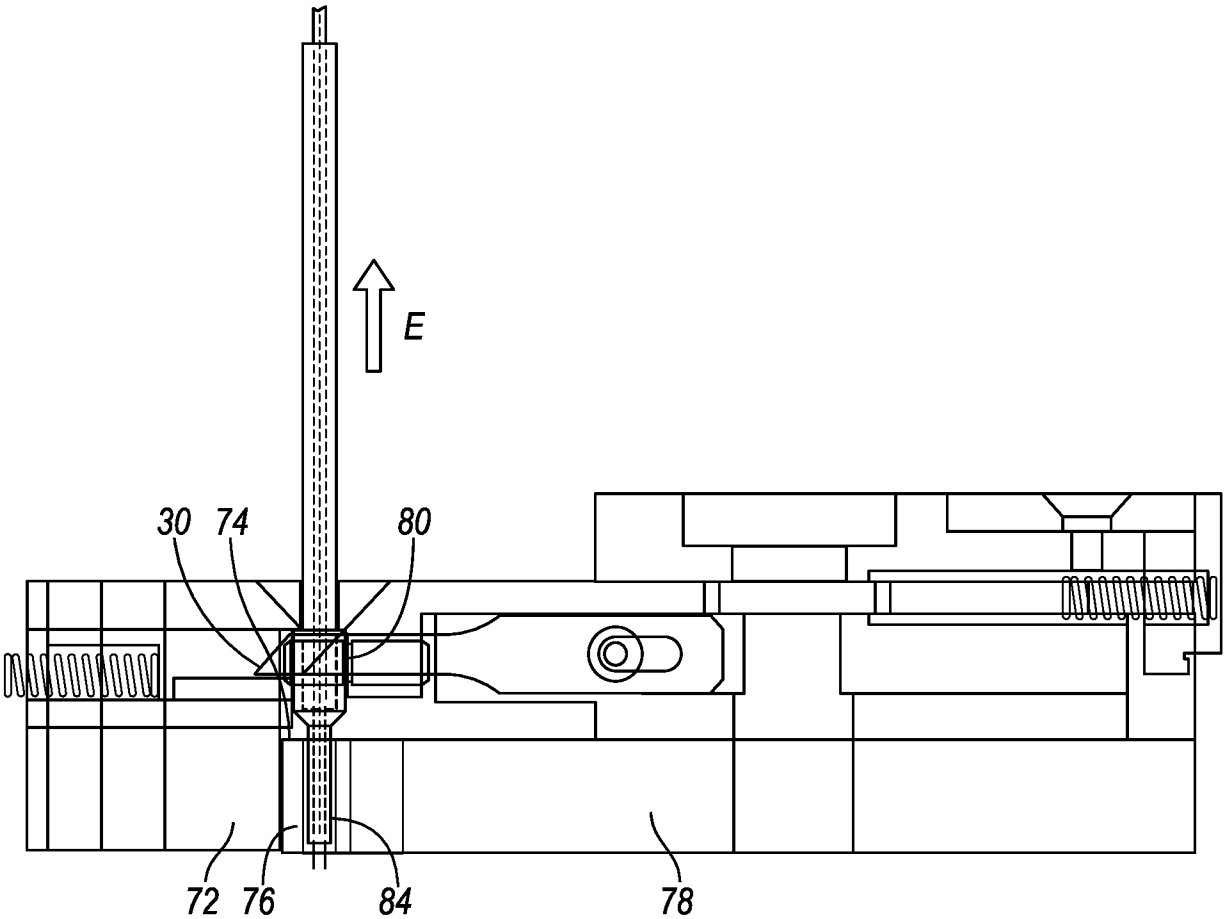
FIG. 11 is an end elevational view of the assembled wire guide tool assembly of FIG. 10 in a fully closed crimping position.

Referring to FIG. 11 and again to FIGS. 6-11, during the crimping operation, the anvil tongue 74 is received in the punch portion 76 of the conductor punch 78, deflecting the crimped portion 84. The slitting end 30 of the slitting blade 28 can be seen at this closed tool position acting to separate the electrical terminal 16 having the bare wire 90 crimped thereto, from the next-in-line electrical terminal on the terminal strip 18. After crimping the crimped portion 84, the assembled electrical terminal 16 and the wire subassembly 86 is automatically removed in a removal direction "E", which is opposite to the installation direction "B".

Referring generally to FIGS. 12-19 and again to FIGS. 1-11, an electrical applicator system or wire guide system 100 is modified from the wire guide system 10 and includes a die 102 releasably retained on a press (not shown). A wire guide tool assembly 104 is releasably mounted to the die 102 and acts with operation of the press to automatically connect an electrical terminal 106 to a wire assembly shown and described in greater detail in reference to FIG. 19, and release the wire assembly and electrical terminal 106 after a fixed connection is made. Wire guide system 100 is modified to crimp wire assemblies such as those having aluminum wires to aluminum electrical terminals 106 which are homogeneously connected to and therefore fed by a terminal strip 108, which may be retained in continuous form after cutting and removal of the individual electrical terminals 106 from the terminal strip 108. Each electrical terminal 106 is separated during the installation sequence from the terminal strip 108 which includes multiple electrical terminals 106 each positioned in a sequential, fixed configuration. An adjustment mechanism 110 is provided to predetermine a depth of crimp to allow multiple different sizes of wire insulation and wire sizes to be accommodated by the die 102.

Figure 13:
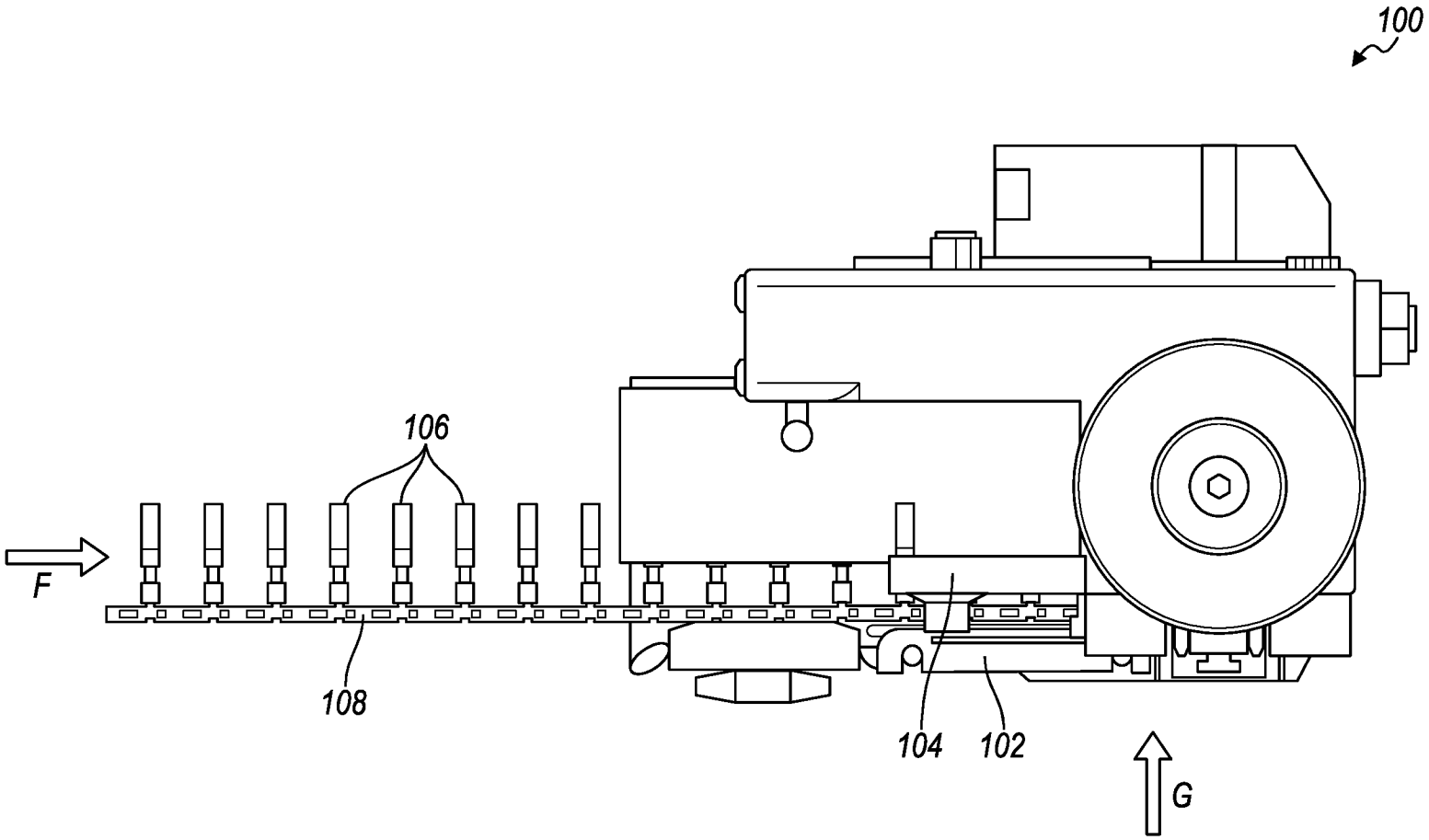
FIG. 13 is a top plan view of the wire guide assembly of FIG. 12.

Referring to FIG. 13, the terminal strip 108 is fed in a feed direction "F" into the die 102. Pre-stripped wire assemblies are fed in an assembly feed direction "G" into the die 102. The assembly feed direction "G" is substantially perpendicular to the feed direction "F".

Figure 12:
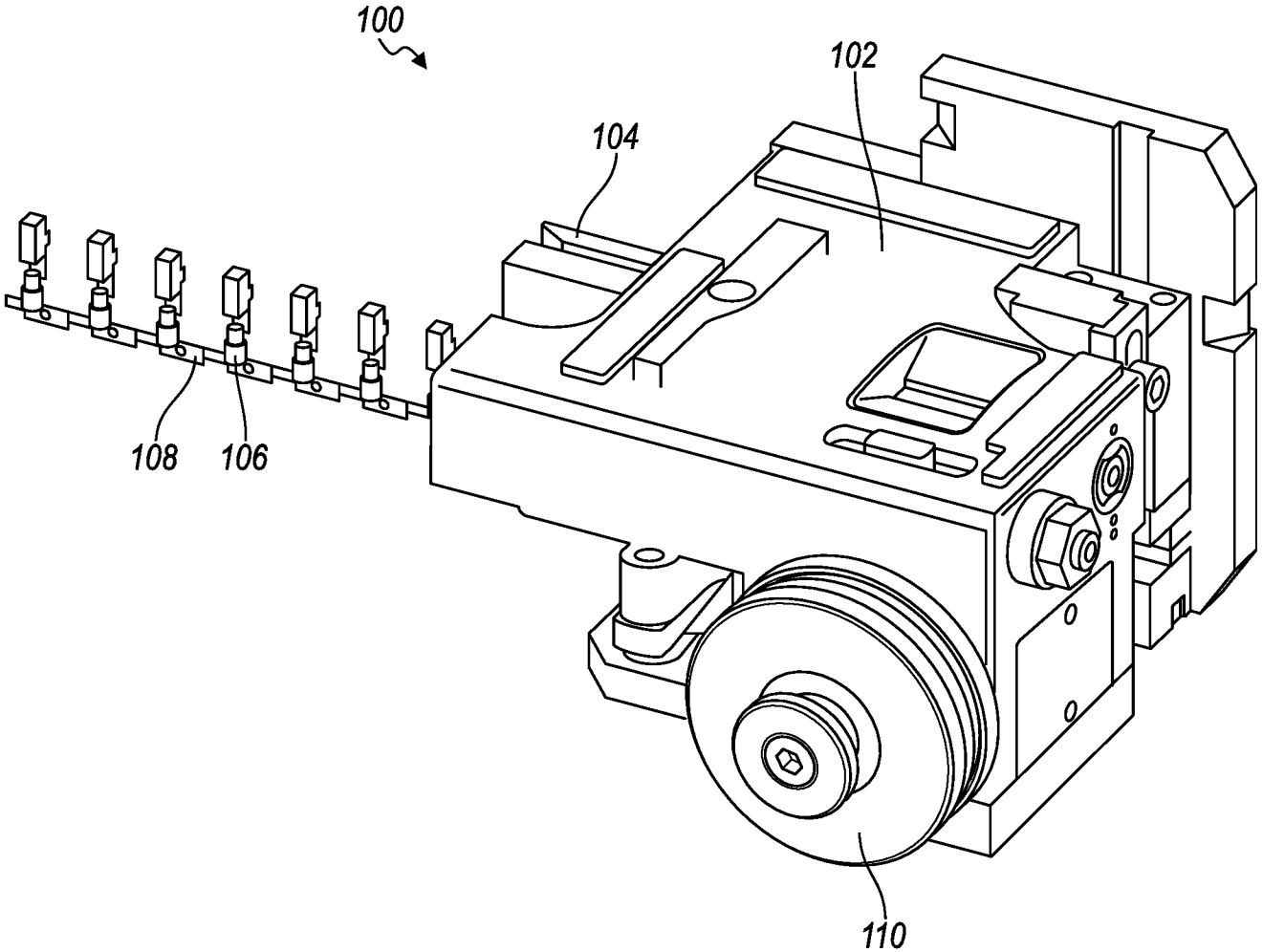
FIG. 12 is a top perspective view of another aspect of a wire guide assembly of the present disclosure.

Referring to FIG. 14 and again to FIGS. 12-13, components of the wire guide system 100 include a ram 112 having a pressure pad spring 114 biasing a slide activator 116. The slide activator 116 is modified from the activator 46 and is coupled to a pressure pad retainer 118. A stop block 120 connects the pressure pad retainer 118 to a pressure pad 122, which includes a pressure pad cover 124. A punch assembly includes an insulation adjuster 126, a conductor punch 128, an insulation punch spring 130, an insulation punch 132, a second or wire guide spring 134, a wire guide 136, a compressor 138, an insulation punch spacer 140, and a spring cover 142. An actuator 144 connected to the punch assembly includes a lever 146 and a pin 148. Wire terminals are fed along a rear stock rail 150 and a stock guide assembly 152 which includes a feed finger guide 154.

A cutter/anvil/die assembly includes a cutter retainer 156, a wire lifter 158, a cutter spring 160, a lifter spring 162, and a cutter 164 guided by a guide pin 166. The wire lifter 158, biased by the lifter spring 162, acts to displace a completed wire assembly after the crimping operation is complete, allowing automatic removal of the wire assembly. The wire lifter 158 is initially downwardly displaced against the biasing force of the lifter spring 162 by legs 204 of the compressor 138 prior to insertion of the wire assembly.

A die section 168 includes a guide pin 170, an insulation anvil 172, and a conductor anvil 174. A terminal rest spring 176 positioned in a second die section 178 biases a terminal rest 180. A die spacer 182 is positioned between the second die section 178 and a pair of lever arms 184. A slide spring 186 and a locating pin 188 allow motion of the lever arms 184 with respect to a slide 190. A slide plate 192 and a slide cover 194 slidably retain a second slide 196. A first head spacer 198 and an optional second head spacer 200 can be positioned between a top of the ram 112 and a dial device 202 for selecting the positioning of the cutters, punches, and conductor anvil.

Referring to FIG. 15 and again to FIG. 12, the die 102 includes the ram 112 rotatably supporting the adjustment mechanism or dial device 202, the slide activator 116, the pressure pad retainer 118, and the pressure pad 122. The conductor punch 128 is positioned proximate to the ram 112, the insulation punch 132, and the wire guide 136 which includes a hemispherical shaped face defining an upper wire guide portion 206. The insulation punch spacer 140 is positioned in elongated apertures 208, 210 of the insulation punch 132 and the wire guide 136 to allow reciprocating motion of these components. The compressor 138 is positioned proximate to the wire guide 136. The insulation punch spring 130 and the wire guide spring 134 bias the insulation punch 132 and the wire guide 136 respectively. The insulation punch spring 130 and the wire guide spring 134 contact the spring cover 142 which is positioned proximate to the actuator 144. A hemispherical shaped face defining a lower wire guide portion 212 is created in the cutter 164, which is oppositely positioned with respect to the hemispherical shaped face of the upper wire guide portion 206. The cutter spring 160 is positioned oppositely about and oppositely directed with respect to the cutter 164 from the lifter spring 162. The insulation anvil 172, the conductor anvil 174, and the die section 178 are together fastened to the cutter retainer 156 and the slide 190. The slide plate 192 is also fastened to the slide 190.

Figure 16:
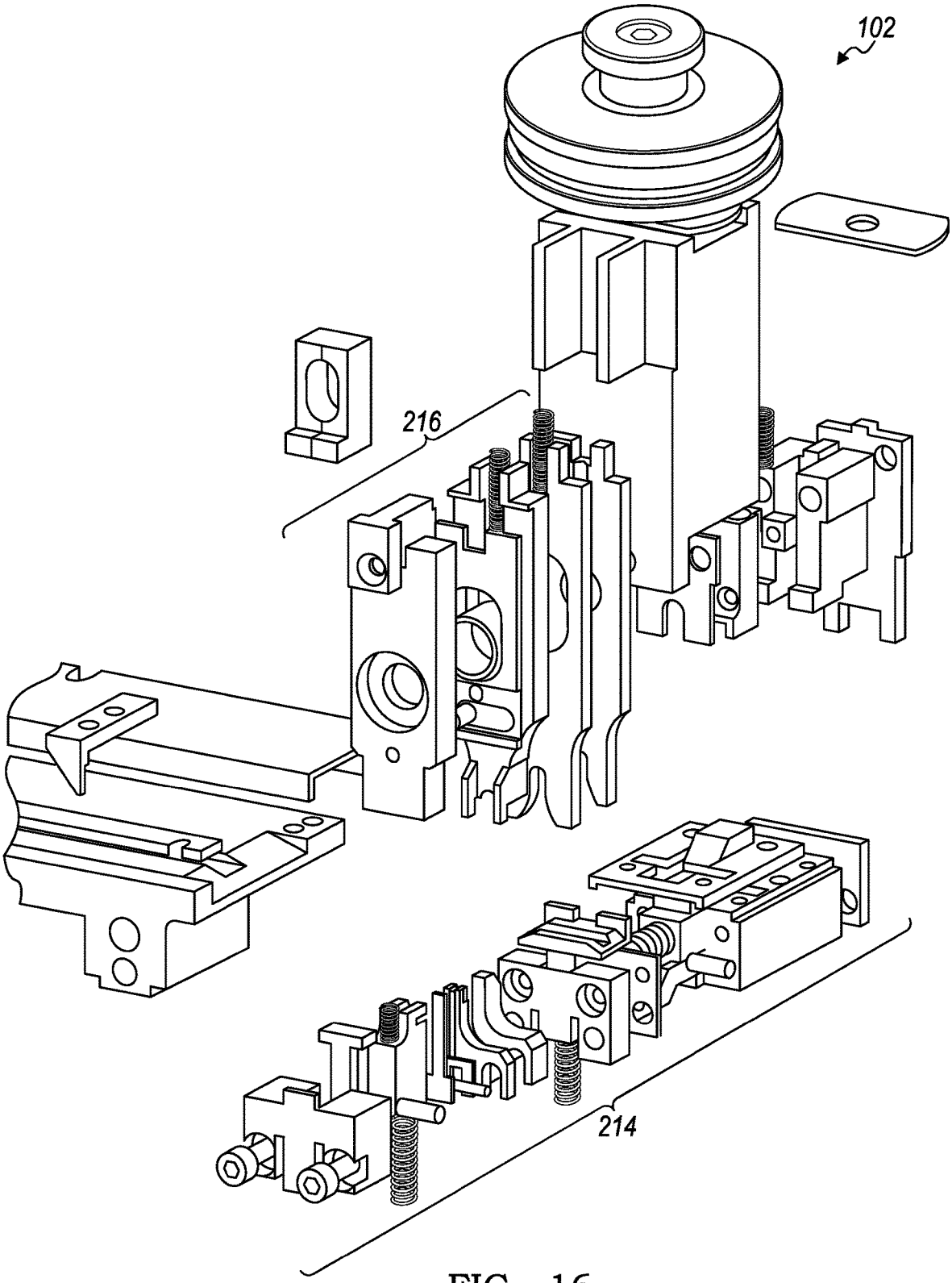
FIG. 16 is a front perspective exploded assembly view of the die similar to FIG. 14.
Figure 17:
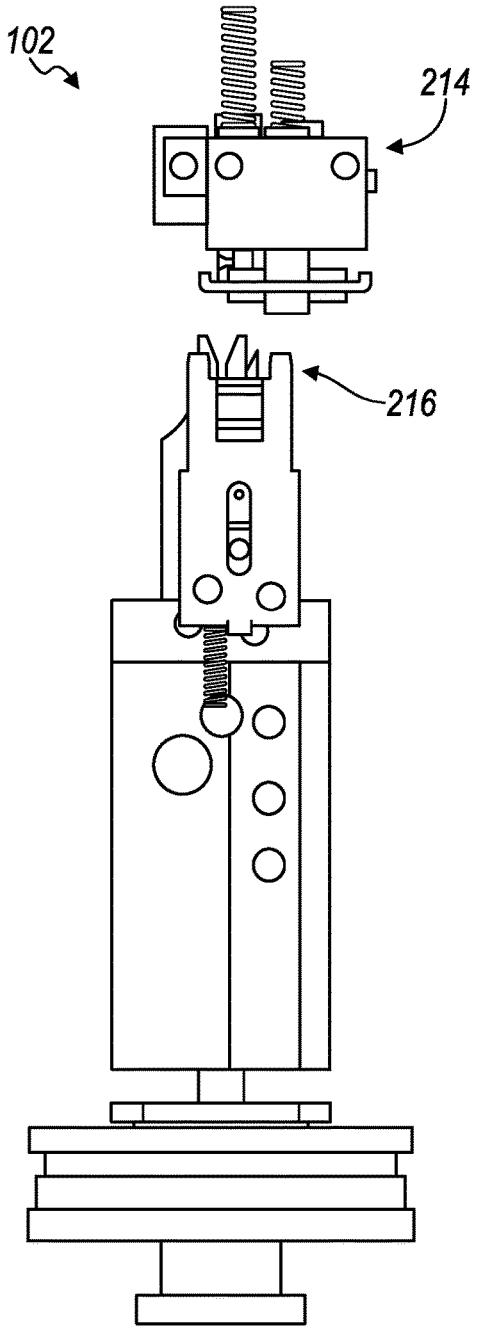
FIG. 17 is an assembled front elevational view of the die assembly of FIG. 14.
Figure 18:
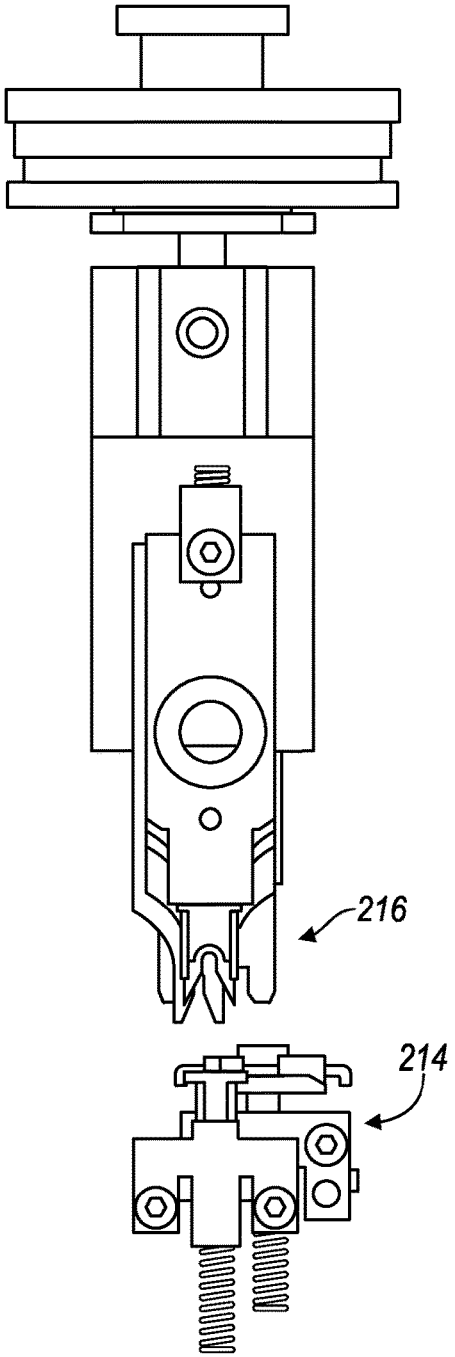
FIG. 18 is an assembled rear end elevational view of the die assembly of FIG. 14.
Figure 19:
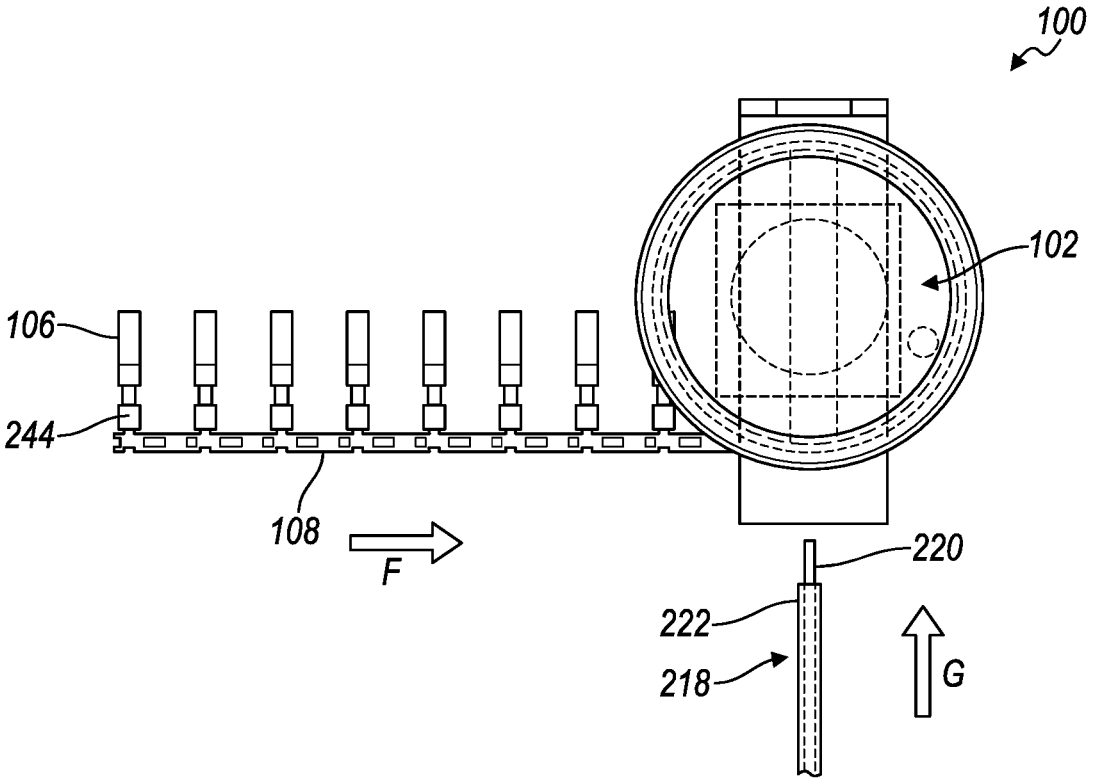
FIG. 19 is a top plan view of the wire guide assembly of FIG. 12.

Referring to FIGS. 16 through 18, portions of the die 102 are divisible into an anvil/cutter portion 214 and a punch portion 216. During operation of the press, the punch portion 216 is displaced toward the anvil/cutter portion 214.

Referring to FIG. 19 and again to FIG. 13, a wire assembly 218 having a stripped wire lead 220 extending from a layer of insulation 222 is fed in the wire feed direction "G" into the die 102 after a next successive one of the electrical terminals 106 of the terminal strip 108 is fed into the die 102 in the feed direction "F".

Figure 14:
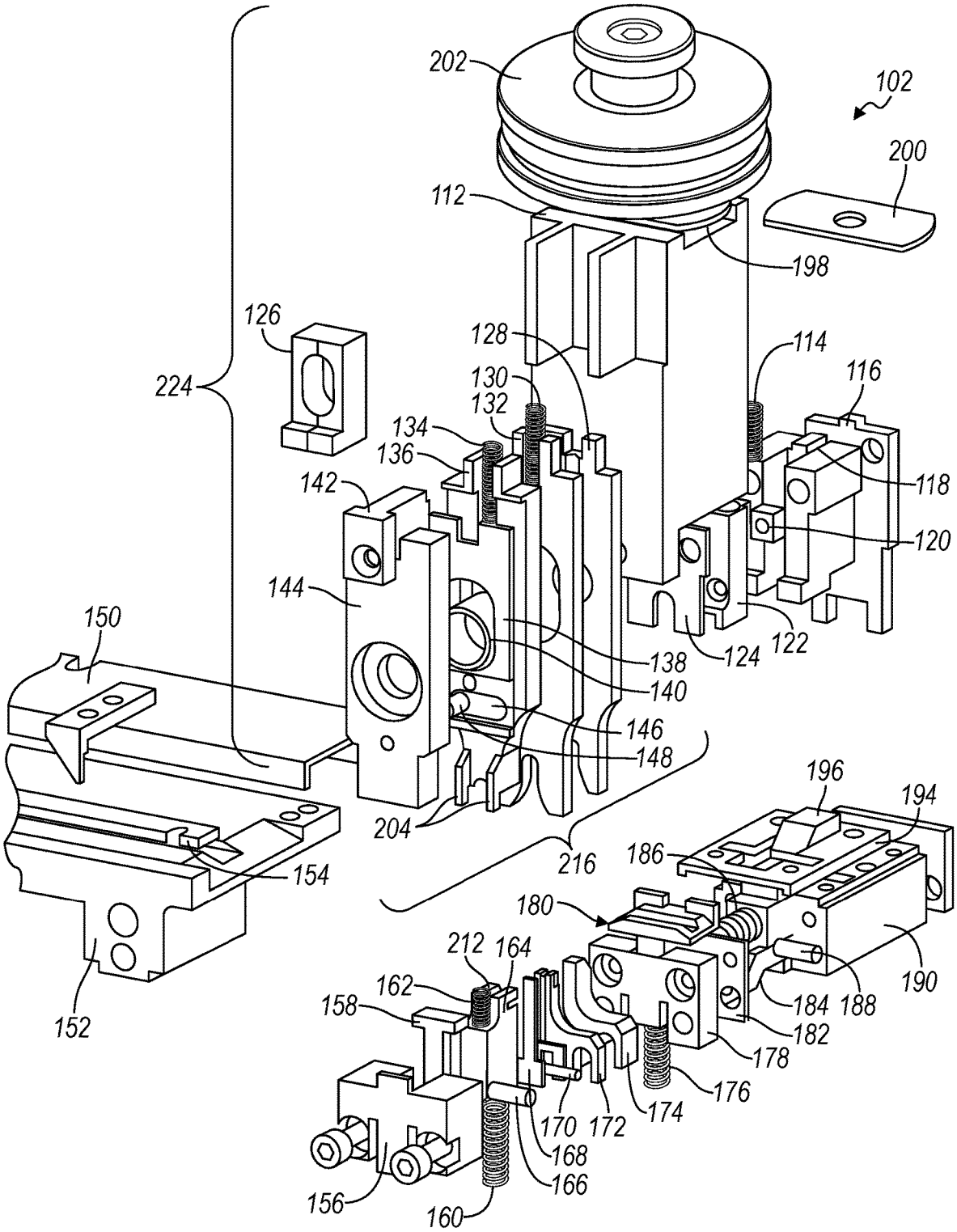
FIG. 14 is a front perspective exploded assembly view of a die of the wire guide assembly of FIG. 12.

Referring generally to FIGS. 13-19, an installation sequence of an electrical terminal 106 is as follows. In a first stage, as shown in FIG. 14 the ram 112 together with the punch portion 216 defining a ram assembly 224 moves downwardly until the legs 204 of the compressor 138 depress against the wire lifter 158. The insulation punch 132 secures a terminal barrel 244 of electrical terminal 106 to the die section 168.

Figure 15:
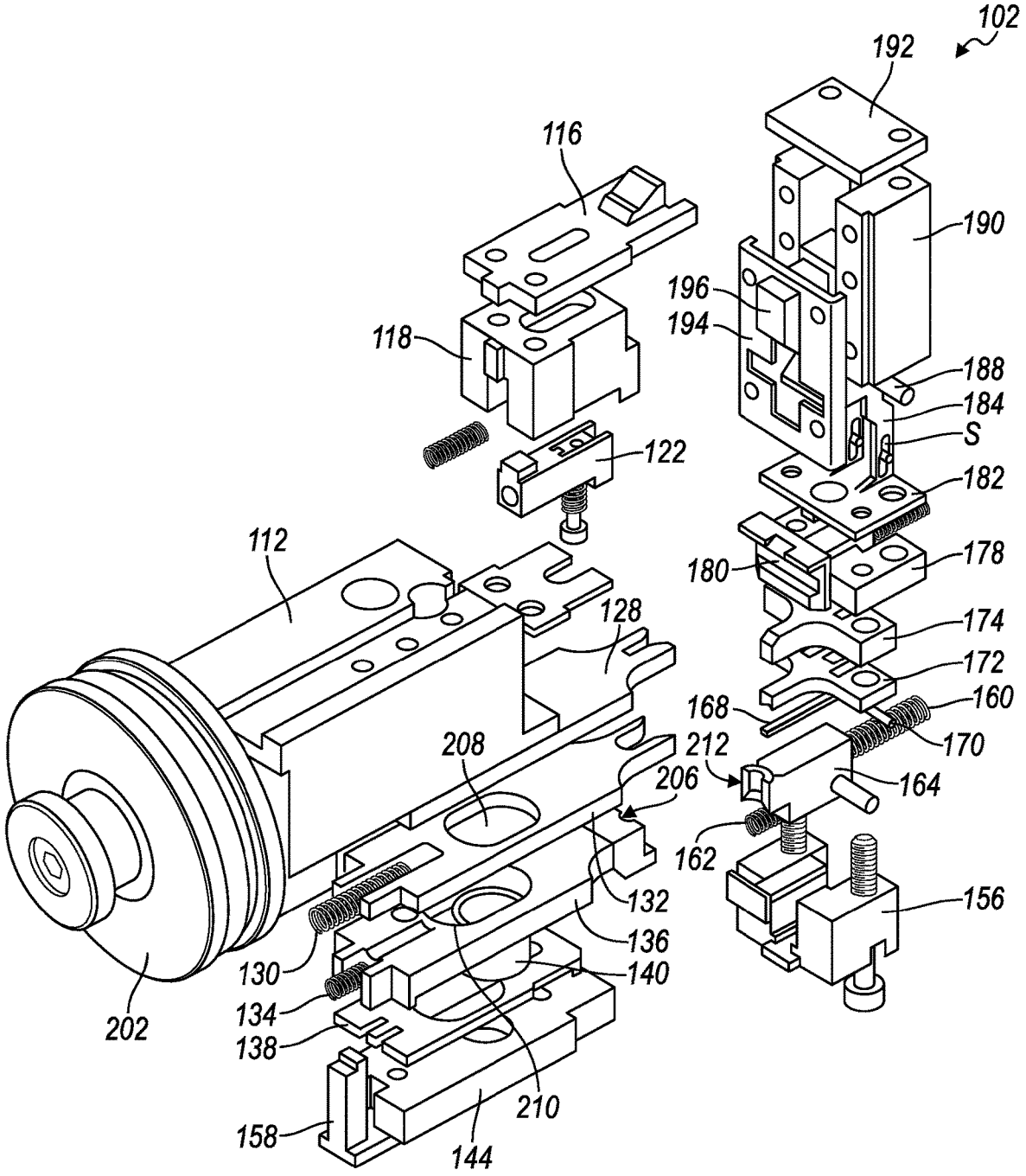
FIG. 15 is a top perspective view of the die assembly of FIG. 14.

In a second stage and in reference to both FIGS. 14 and 15, the ram assembly 224 continues to move downward until the slide activator 116 engages the slide 196 and the slide 196 and the locating pin 188 move to an initial position. The slide 196 and the guide pin 170 which is positioned in elongated slots "S" created in the lever arms 184 move to the forward initial position. The die section 168 and the guide pin 170 are both supported by the slots "S" in the lever arms 184. The cutter 164 and the guide pin 170 are then displaced downwardly. The terminal barrel 244 of the electrical terminal 106 is separated from the carrier or terminal strip 108. The hemispherical shaped face of the upper wire guide portion 206 of the wire guide 136 contacts the hemispherical shaped face of the lower wire guide portion 212 of the cutter 164 forming a conical wire guide.

In a third stage, and with continuing reference to FIGS. 14 and 15, the ram assembly 224 continues to move downward until the slide activator 116 engages the slide 196 defining a second position. The slide 196 and the guide pin 170 move toward the second position. The die section 168 and the guide pin 170 are displaced downward by the angled slot in the lever arms 184. As previously noted, the upper wire guide portion 206 of the wire guide 136 contacts the lower wire guide portion 212 of the cutter 164 forming a conical wire guide which coaxially receives the terminal barrel 244 of the electrical terminal 106. The stripped wire lead 220 is inserted through the wire guide 136 into the terminal barrel 244 of the electrical terminal 106.

In a fourth stage, the ram assembly 224 bottoms out. The conductor punch 128 also defining a crimping tool punch and the insulation punch 132 engage the conductor anvil 174 and the insulation anvil 172 to compress the terminal barrel 244 and form a crimped terminal.

In a fifth stage, the ram assembly 224 begins to move upward, which reverses the motions of the fourth stage.

In a sixth stage, the ram assembly 224 continues to move upward, which reverses the motions of the third stage.

In a seventh stage, the ram assembly 224 continues to move upward, which reverses the motions of the second stage.

In an eighth stage, the ram assembly 224 continues to move upward, which reverses the motions of the first stage. The wire lifter 158 is biased to release upwardly, thereby upwardly displacing and releasing the completed and crimped wire terminal assembly for automatic removal from the die 102.

Figure 20:
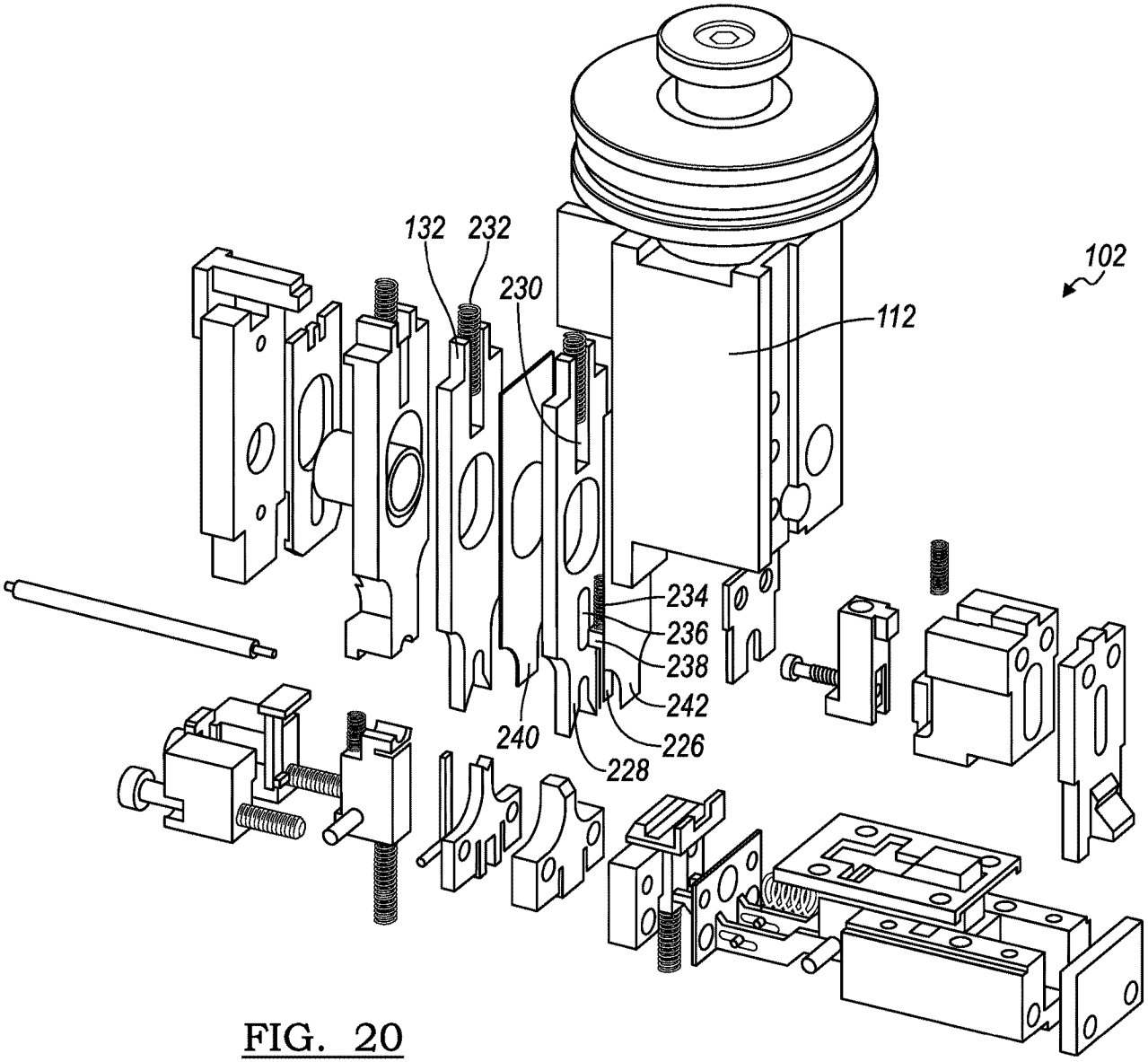
FIG. 20 is a front left perspective exploded assembly view of the die similar to FIG. 14 further providing a spring biased wire stop.

Referring to FIG. 20 and again to FIGS. 13-19, according to several aspects, a spring biased wire stop 226 is provided to prevent the insertion of the wire 90 beyond a maximum inserted position of the length of insulation 88 and the length of bare wire 90 stripped of the insulation 88. A conductor punch 228 is modified from the conductor punch 128 to include a slot 230. A spring 232 is provided in the slot 230 to downwardly bias the conductor punch 228. At least one spring 234 is positioned in a second slot 236 provided in the conductor punch 228 which is biased against a tab 238 of the spring biased wire stop 226, with the at least one spring 234 and the tab 238 both positioned in the second slot 236. The at least one spring 234 biases the spring biased wire stop 226 downwardly. The use of the spring biased wire stop 226 allows positive contact with the electrical terminal 106 in the pre-crimp position. In addition, a first punch guide 240 is provided between the insulation punch 132 and the conductor punch 228, and a second punch guide 242 is positioned between the conductor punch 228 and the ram 112 to maintain the position of the spring 232 within the pocket 230 of the conductor punch 228. The conductor punch 228 can therefore slide or "float" between the first punch guide 240 and the second punch guide 242 due to the addition of the spring 232.

The term "homogeneous" (or homogeneously) as used herein is defined as a part, component, member, or the like (collectively the part) having all portions of the part formed of the same material and by the same process used to create the part, such as but not limited to molding including injection molding, or by forging or casting, such that no portion(s) of the part require connection to any other portion by a secondary process including but not limited to fastening, welding, adhesive bonding, mechanical connection, second molding or casting process, or the like, and the chemical properties of the part material are substantially equivalent throughout the part.

The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises", "comprising", "including", and "having" are inclusive and therefore specify the presence of stated features, integers, steps, operations, elements and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first", "second", and other numerical terms when used herein do not imply a sequence or order unless clearly indicated by the context. Thus, a first element, component, region, layer or section discussed below could be termed a second element, component, region, layer or section without departing from the teachings of the example embodiments. As used herein, the term "and/or" includes any and all combinations of one or more of the associated listed items.

The description of the invention is merely exemplary in nature and variations that do not depart from the gist of the invention are intended to be within the scope of the invention. Such variations are not to be regarded as a departure from the spirit and scope of the invention.

What is claimed is:

1. A wire guide system, comprising:

a wire guide tool assembly releasably mounted to a die acting during operation of a press to automatically connect an electrical terminal to a wire subassembly;

a wire stop positioned to prevent an insertion of the wire subassembly beyond a maximum inserted position;

an upper wire guide of the wire guide tool assembly;

a lower wire guide of the wire guide tool assembly movable reciprocally with respect to the upper wire guide such that the upper wire guide temporarily contacts the lower wire guide;

a cutter anvil die assembly mounted on the lower wire guide, the cutter anvil die assembly including a cutter retainer, a lifter, a cutter spring, a lifter spring biasing the lifter, and a cutter guided by a guide pin, the lifter slidably disposed with respect to the lower wire guide, the lifter having an end face normally positioned above an upper face of the lower wire guide, the lifter slidably received in a slot created in a terminal ramp which is oppositely positioned with respect to the lower wire guide;

a canted lifter member integrally connected to the terminal ramp and extending upwardly from an upper ramp face of the terminal ramp, the lifter member indexing a next-in-line electrical terminal connected to a terminal strip; and a terminal barrel of the next-in-line electrical terminal displaced by the lifter away from contact with the lower wire guide after the next-in-line electrical terminal is crimped to the wire subassembly and the upper wire guide is moved away from the lower wire guide, thereby providing clearance to automatically remove the wire subassembly having the next-in-line electrical terminal crimped thereto from the wire guide tool assembly.

2. The wire guide system of claim 1, further comprising:

a punch assembly having an insulation adjuster, a conductor punch, an insulation punch, and a compressor having multiple legs;

wherein the compressor moves until the legs of the compressor depress against the lifter and the insulation punch secures the terminal barrel of the next-in-line electrical terminal.

3. The wire guide system of claim 2, further comprising an anvil assembly having a conductor anvil and an insulation anvil.

4. The wire guide system of claim 3, wherein the conductor punch defines a crimping tool punch.

5. The wire guide system of claim 4, further comprising a stripped wire received through a conical wire guide formed when the upper wire guide temporarily contacts the lower wire guide and also received in the terminal barrel of the next-in-line electrical terminal, the crimping tool punch and the insulation punch when engaged with the conductor anvil and the insulation anvil compress the terminal barrel positioned in the conical wire guide and an insulation layer thereby forming a crimped terminal.

6. The wire guide system of claim 3, wherein the insulation punch is engaged with the conductor anvil and the insulation anvil to compress the terminal barrel.

* * * * *